United States Patent [19]

Burney

[11] Patent Number: 4,850,254

[45] Date of Patent: Jul. 25, 1989

[54] ADJUSTABLE LOCKING HAND TOOL

[75] Inventor: Burrell T. Burney, DeWitt, Nebr.

[73] Assignee: Petersen Manufacturing Co., Inc., Lincoln, Nebr.

[21] Appl. No.: 240,360

[22] Filed: Aug. 31, 1988

Related U.S. Application Data

[63] Continuation of Ser. No. 18,614, Feb. 25, 1987, abandoned.

[51] Int. Cl.[4] ..... B25B 7/12

[52] U.S. Cl. ..... 81/367; 81/129; 269/228

[58] Field of Search ..... 81/367, 368, 369, 370, 81/382, 371, 373, 129, 150, 153; 269/6, 201, 228, 166

[56] References Cited

U.S. PATENT DOCUMENTS

| | | | |
|---|---|---|---|
| 3,933,346 | 1/1976 | Carver . | |
| 4,088,313 | 5/1978 | Pearson | 269/166 |
| 4,563,921 | 1/1986 | Wallace | 81/373 |

OTHER PUBLICATIONS

James Morton, Hand Clamp Catalog 185, pp. 3 & 4, 5/22/86.

James Morton, Hand Clamp Catalog 185, p. 5, "Bessey Deep Reach Clamp", 5/22/86.

*Primary Examiner*—Frederick R. Schmidt
*Assistant Examiner*—Maurina Rachuba
*Attorney, Agent, or Firm*—Lackenbach Siegel Marzullo & Aronson

[57] ABSTRACT

A locking hand tool has an adjustable jaw and an opposing movable infinitesimally adjustable jaw, a fixed handle and a movable handle and lever-locking means therebetween for establishing and maintaining a toggle relation between the jaws when in a closed position, an extension bar at a fixed angle to the fixed handle, means for supporting and moving the movable jaw along the extension bar, and means for holding it securely at any position, whereby a user can clamp on and hold a workpiece securely with the use of only one hand.

19 Claims, 1 Drawing Sheet

ADJUSTABLE LOCKING HAND TOOL

This application is a continuation of application Ser. No. 018,614, filed Feb. 25, 1987, abandoned.

FIELD OF THE INVENTION

This invention relates generally to toggle-locking hand tools. More specifically it relates to toggle-locking hand tools of the pliers type with one adjustable jaw and one movable jaw, mounted and supported on a fixed extension bar, mounted on a fixed handle, which is optionally replaceable. A movable handle, pivotably mounted on the adjustable jaw optionally including a release lever, controls a conventional four-pivot toggle locking mechanism.

This novel class of locking hand tools with a movable jaw and and an adjustable jaw may have jaws with tips defining arcuate pliers, straight pliers, long-nosed pliers, C-clamps, hole punches, wire cutters or any other type of locking hand tool.

BACKGROUND OF THE INVENTION

Pliers-type hand tools with toggle-locking lever link mechanisms are generally known as toggle wrenches or locking pliers. These conventional tools usually comprise a fixed handle integral with a fixed jaw member and a movable jaw pivotably mounted on the fixed handle, a movable handle pivotably mounted on the movable jaw and a lever link pivotably mounted on the movable handle and extending to an adjustable point inside a channel in the fixed handle. This four-pivot mechanism is known as a toggle linkage. Conventionally a release lever for the toggle lock is pivotably mounted in the channel of the movable lever.

Certain patents which describe toggle locking hand tools are as follows:

| Inventor | U.S. Pat. No. | Date of Issue |
|---|---|---|
| W. Petersen | 1,489,458 | Apr. 18, 1924 |
| W. Petersen | 2,201,918 | May 21, 1940 |
| W. Petersen | 2,280,005 | Apr. 14, 1942 |
| Borchers | 2,299,454 | Oct. 20, 1942 |
| Toernberg | 2,341,489 | Feb. 8, 1944 |
| W. Petersen | 2,417,013 | Mar. 4, 1947 |
| C. Petersen | 2,563,267 | Aug. 7, 1951 |
| C. Petersen | 2,590,031 | Mar. 18, 1952 |
| W. Petersen | 2,711,663 | Jun. 28, 1955 |
| W. Petersen | 2,853,910 | Sept. 30, 1958 |
| Hostetter | Re. 26,280 | Jan. 7, 1964/ Oct. 17, 1967 |
| C. Petersen et al | 3,192,804 | Jul. 6, 1965 |
| Schroeder | 3,585,704 | Jun. 22, 1971 |
| Marasco | 3,590,669 | Jul. 6, 1971 |
| Baldwin | 3,600,986 | Aug. 24, 1971 |
| C. Petersen | 4,541,312 | Sept. 17, 1985 |
| C. Petersen | 4,546,680 | Oct. 15, 1985 |

Conventional locking hand tools may have jaws in the form of C-clamps, as in U.S. Pat. No. 2,641,149; in the form of chain clamps as in U.S. Pat. No. 3,192,804; in the form of long nose pliers as in U.S. Pat. Nos. 4,541,312 and 4,546,680; in the form of a straight jaw as in U.S. Pat. Nos. 2,201,918 and 2,280,005; in the form of curved jaws as in U.S. Pat. Nos. 2,563,267 and 2,853,910; in the form of a wire cutter as in U.S. Pat. No. 2,590,031; and in the form of an involute jaw as in U.S. Pat. No. 2,563,267. Locking hole punches are also known.

The novel mechanism of the present invention may be applied to the types of locking hand tools listed above or any other type of locking hand tool. All these tools have the basic purpose of seizing a workpiece and holding it firmly, when appropriately adjusted, accuated by the locking action of compressing the movable handle and the fixed handle. A release lever is provided to release the toggle-locking action in all of these hand tools.

U.S. Pat. No. 4,553,305 discloses a pipefitter's scribing and spacing tool with a series of complex static adjustments.

U.S. Pat. No. 4,483,059 shows a clamping and spacing tool with a pair of clamping jaws and shims which may be manipulated to provide a gap.

U.S. Pat. No. 4,344,215 discloses a pipefitter's tool with a jaw controlled by the movable handle and a U-shaped fixed jaw adjustable with bolts.

U.S. Pat. No. 4,306,345 discloses a pipefitter's tool with an internal fitting adjustable with shims and bolts.

U.S. Pat. No. 4,083,548 discloses an adjustable clamp in the form of two jaws mounted on a common bar.

U.S. Pat. No. 3,836,136 shows a racheted frame member bearing a clamp pad and a pivotably mounted clamp arm.

U.S. Pat. No. 3,241,410 discloses an adjustable racheted jaw on a racheted movable extension bar.

U.S. Pat. No. 3,092,378 discloses a C-clamp parallel to a main frame.

All eight of the preceding patents in the prior art have some type of toggle-locking mechanism.

OBJECTS OF THE INVENTION

The principal object of the present invention is to provide a locking hand tool of the pliers type wherein the gap between two jaws is varied by a novel movable jaw fixed to an extension bar and by a conventional adjustable jaw.

It is a further object of the invention to provide a hand tool of the locking pliers type, wherein the gap between the jaws may be varied at least partially by gravity so that it may be operated, if desired, by only one hand.

It is an additional object of present invention to provide a fixed extension bar of any convenient length bearing a movable jaw at any angle between about 45 degrees and about 135 degrees from the axis of the fixed handle of a hand tool of the toggle-locking pliers type.

It is yet another object to provide a toggle-locking hand tool of the pliers type with a fastening means for mounting an extension bar on the fixed handle, so that an extension bar of another size or a new bar of the same size may be substituted for the original extension bar.

It is still another object to provide a support means and a moving means for a movable jaw of the hand tool of the present invention, so that the movable jaw may move smoothly along an extension bar and yet lock firmly at any chosen point along the extension bar.

It is another object to provide a hand tool of the invention with a limit stop at the free end of an extension bar.

The further object of my invention is to provide a hand tool of the locking pliers type which has adjustable and movable jaws with tips of the straight, arcuate, involute, hole punch, long nose, wire cuttings, C-clamp, or swivel pad type, or any combination thereof.

Yet a further object of the invention is to provide indicia means, so that the source of the hand tool may be perceived.

Other objects of the invention will be apparent to those skilled in the art.

SUMMARY OF THE INVENTION

The objects of the invention cited above are realized by a novel toggle-locking, pliers-type, hand tool with dual infinitesimally adjustable capability comprising:

(a) a movable jaw and an opposing adjustable jaw, (b) a fixed handle including adjustment means and a movable handle and lever-locking means therebetween for establishing and maintaining a toggle relation between the jaws when in a closed position, the adjustable jaw being pivotably mounted on the fixed handle and the movable handle being pivotably mounted on the adjustable jaw.

(c) an extension bar mounted at a fixed angle to the fixed handle between from about 45 degrees to about 135 degrees from the axis of the fixed handle, (d) means for supporting and moving the movable jaw along the extension bar, and means for holding it securely at any position along the extension bar, so that a user can clamp on and hold a workpiece securely with the use of only one hand, if desired.

The preferred hand tool has a channeled support place holding the movable jaw to one face of the extension bar and holding a spacer member, preferably circular, to the opposite face of the extension bar, which is preferably mounted at an angle of about 90 degrees to the fixed handle.

Preferably the movable jaw has an end having an arcuate, outer, protuberent corner with a radius of curvature from about 1/16 inch (1.5 mm) to about 7/16 inch (12 mm), whereby the movable jaw can be locked and unlocked at any point along the fixed extension bar, creating a variable angle of between from about 2 degrees to about 8 degrees, preferably about 5 degrees, as it changed from locked to unlocked positions. The supporting piece holding the movable jaw may be exogenously moved or it may be endogenously moved by gravity.

Further preferred is an adjustment screw in the channel of the fixed handle cooperating with the end of the toggle lever link to control the position of the adjustable jaw.

The preferred tips for the adjustable and movable jaws are those in a C-clamp configuration with swivel pads. The jaws may also be straight, serrated, arcuate, involute, hole punch, long nosed, wire cutting, or any combination thereof.

Also preferably contained in this novel class of hand tool are a toggle releasing lever pivotably mounted on the movable handle, a limit stop at the free end of the extension bar, fastening means for attaching and replacing the extension bar to the fixed handle, preferably in the form of a winged nut and bolt, and indicia means for indicating the source of the novel locking hand tool of this invention.

DESCRIPTION OF A PREFERRED EMBODIMENT

Figures 1, 2:
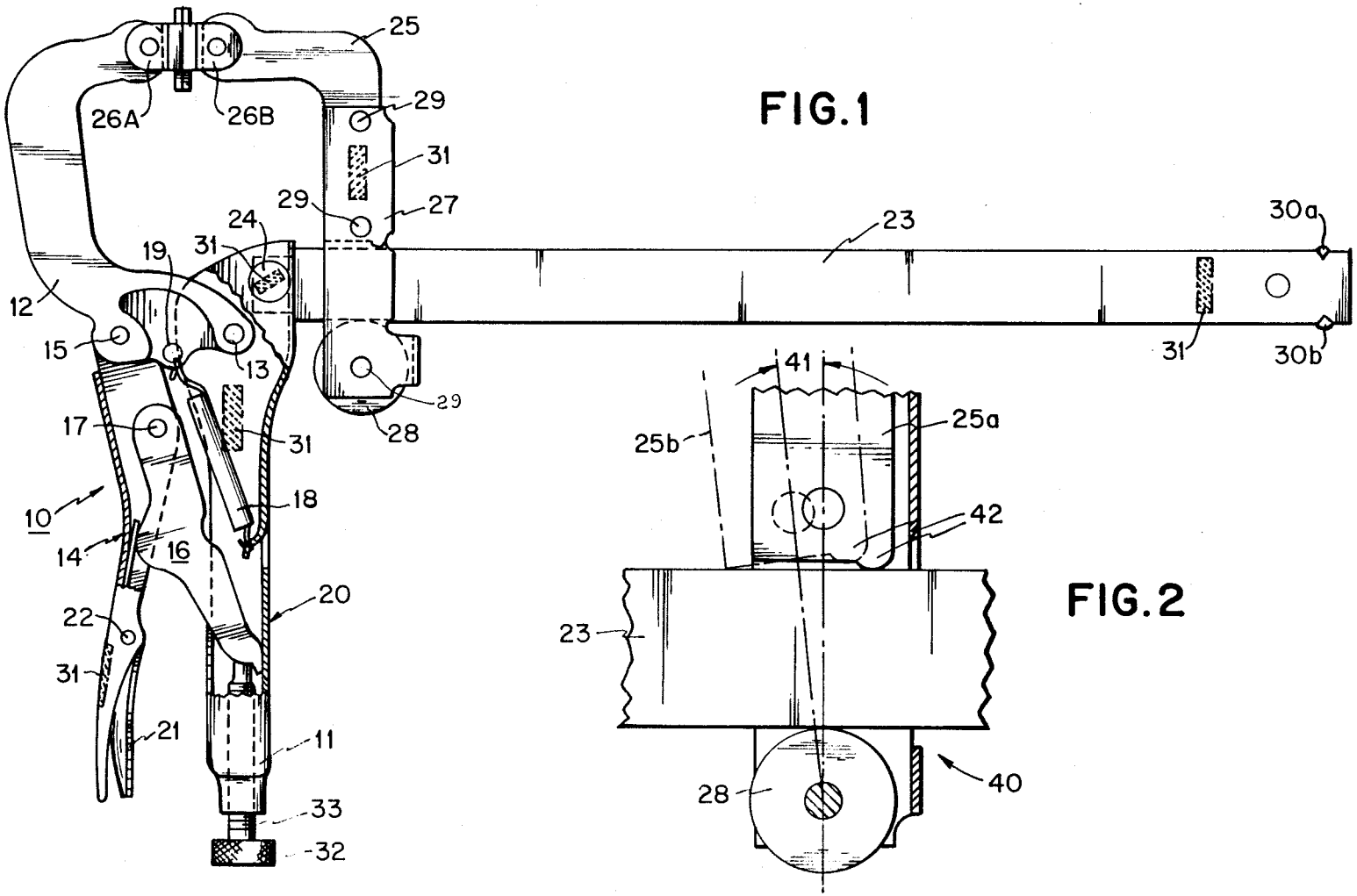
FIG. 1 is a plan view of one embodiment of the present invention.
FIG. 2 is a diagrammatic view of the portion of the fixed extension bar where the unshown support piece holds the end of the movable jaw.

It is understood that the drawings show only one embodiment of the invention. Many other embodiments can be produced which fall within the scope of the Summary above and the claims below. In these Figures the same or similar elements are designated by the same numbers throughout.

An embodiment of the present invention is shown in FIG. 1 generally as numeral 10. Fixed handle 11 has pivotably mounted on it adjustable jaw 12 at pivotably point 13, which is shown as a rivet. It is understood, however, that a nut and bolt or any other suitable pivoting means can be used at this and/or the other pivot points. Movable handle 14 is mounted pivotably on adjustable jaw 12 at pivot point 15 indicated e.g. by a rivet. Locking lever 16 is pivotably mounted on the movable handle 14 at pivot point 17, which is a rivet or the like, and extends into the channel of fixed handle 11 where it is engaged by the end of adjusting means, exemplified by the end of adjusting screw 13 controlled by e.g. knurled adjusting knob 32. It is understood that other equivalent adjusting means and other adjustment knobs such as a slotted screw head could also be employed. Also connecting adjusting jaw 12 near its base extending from lug or hole 19 to another unseen lug or hole inside the channel of fixed handle 11, designated by arrow 20, is tension spring 18. Release lever 21 is shown mounted pivotably at pivot point 22 e.g. a rivet inside the channel of movable handle 14 near its free end.

Fixed extension bar 23 can be of any convenient length e.g. 10 inches (25 cm) or 18 inches (42 cm). Extension bar 23 is fastened to the fixed handle 11 by e.g. nut 24, but it is understood that a rivet, an adhesive, or any fastening means either easily replaceable such as a winged bolt and nut, or not easily replaceable e.g. cyanoacrylate adhesive may be employed. Easily replaceable fastening means are preferable, so that an extension bar of a different length or a new extension bar may be substituted for the original fixed extension bar 23.

Movable jaw 25 is supported and moved e.g. by supporting piece 27 to which it is connected by three similar fasteners such as three rivets 29. It is understood that other fastening means such as nut and bolts or adhesives could also be used. Extension bar 23 is shown in a channel within support piece 27 in a sliding relation. Held to the face of extension bar 23 opposite to that of movable jaw 27 is spacer member 28, which is shown as circular, but which may be of any other arcuate, flat-sided shape. This spacer has several functions among which is to maintain the proper alignment of the parallel faces of the channel of support piece 27. It is preferred that one of the fasteners 29 be at or near the geometrical center of space 28. In FIG. 1 the shape of adjustable jaw 12 and movable jaw 25 define a C-clamp, but it is understood that other shapes and functions for the jaws may be employed such as straight, arcuate, curved, hole punch, wire cutter, long nose, and the like. Both movable jaw 25 and adjustable jaw 12 end in cooperating tips functioning as swivel pads **26*a* and 26*b*, but it is understood that grooved tips, serrated tips, arcuate tips, textured milled tips, plain tips, or any other tips or combination thereof helpful in seizing a workpiece. A pair of bosses 30*a* and 30*b* provide a limit stop function, but it is understood that cuts, flanges, soldered joint or any other similar type of protrusion may also sever as a limit stop at the free end of the fixed extension bar 23**.

Smooth surfaces and bolt heads or rivet heads, and the like, indicated by five places numbered 31 serve as preferred points to imprint specific markings, letters, numbers, and/or words to indicate the source of manufacture of the hand tools of the present invention and to inhibit either domestic or foreign counterfeiting.

Diagrammatic FIG. 2 shows generally, indicated by 40, a plan view of a section of extension bar 23, the entire spacer 28, and the end of movable jaw 25 away from swivel pad **26*b*. The outer corner of the sliding end of the movable jaw has an arcuate protuberance 42, which has a radius of curvature from about 1/16 inch (1.5 mm) to about 7/16 inch (12 mm), preferably about 3/16 inch (5 mm). This proturberance 42 causes the sliding end to alternate, either endogenously by gravity or exogenously by a user, from locked position 25*a* to unlocked position 25*b* as the movable jaw 25 slides or is slid to any point along extension bar 23. The clearance angle 41 created by the alternation between locked position 25*a* and unlocked position 25*b*** may range from about 2 degrees to about 8 degrees and is preferably about 5 degrees.

Although the present invention has been particularly described by FIGS. 1 and 2, it will be understood, of course, that various modifications and alternatives may be chosen in the form, sizes, details, and arrangement of the parts of the present invention and still remain within the scope of the invention, as set forth in the claims.

I claim:

1. A locking hand tool having an adjustable jaw and an opposing movable infinitesimally adjustable jaw having a sliding end, a fixed handle and a movable handle and lever-locking means therebetween for establishing and maintaining a toggle relation between the jaws when in a closed position, an extension bar at a fixed angle to the fixed handle, means for supporting and moving the movable jaw along the extension bar, said supporting and moving means comprising a channeled supporting means holding said sliding end of the movable jaw to one face of the extension bar and holding a spacer member to the opposite face of the extension bar, said one face of the extension bar being smooth and said opposite face of the extension bar also being smooth, said sliding end of the movable jaw having an arcuate protuberance which causes the sliding end to alternate from a locked position to an unlocked position as the movable jaw slides or is slid to any point along the extension bar, and wherein the arcuate protuberance is at the outer corner of the sliding end of the movable jaw, whereby the combination of the arcuate protuberance, the spacer, and the distance between them provides the friction to cause the movable jaw to lock in place along the extension bar.

2. The locking hand tool of claim 1 wherein the sliding end of the movable jaw has an arcuate, corner with a radius of curvature from about 1/16 inch to about 7/16 inch, whereby the movable jaw can be at any point along the fixed extension bar.

3. The locking hand tool of claim 1, wherein the spacer member is circular.

4. The locking hand tool of claim 1, wherein the angle between the fixed extension bar and the fixed handle is about 90 degrees.

5. The locking hand tool of claim 1, wherein the fixed extension bar is about 10 inches (25 cm) long.

6. The locking hand tool of claim 1, wherein the fixed extension bar is about 18 inches (42 cm) long.

7. The locking hand tool of claim 1, wherein the tips of the extendable jaw and adjustable jaw are arcuate.

8. The locking hand tool of claim 1, wherein the tips of the extendable jaw and opposing adjustable jaw are in the form of swivel pads.

9. The locking hand tool of claim 1, further comprising a releasing means for the lever locking means.

10. The locking hand tool of claim 9, wherein the lever locking means is a release lever located on the inner channel of the movable handle.

11. The locking hand tool of claim 1, wherein the extension bar is held at a fixed angle to the fixed handle by fastening means, whereby one extension bar may be substituted for another extension bar.

12. The locking hand tool of claim 11, wherein the fastening means is a bolt and wing nut.

13. The locking hand tool of claim 1, further comprising indicia means indicating the source of the hand tool.

14. The locking hand tool of claim 1, further comprising stop means at the free end of the extension bar for limiting the outward movement of the supporting means.

15. The locking hand tool of claim 1, wherein the movable jaw and adjustable jaw define a C-clamp.

16. The locking hand tool of claim 1, wherein the fixed handle includes means for infinitesimally adjusting the adjustable jaw.

17. The locking hand tool of claim 16, wherein the toggle relation is defined by toggle locking means, said toggle locking means having a toggle locking lever, and wherein the adjusting means on the fixed handle cooperates with the toggle locking lever to adjust the adjustable jaw.

18. The locking hand tool of claim 1, wherein a clearance angle is created between the sliding end of the movable jaw and the extension bar as the jaw alternates between said locked position and said unlocked position along the extension bar.

19. The locking hand tool of claim 18, wherein the clearance angle is from about 2 degrees to about 8 degrees.

* * * * *